US005706867A

United States Patent [19]

Liao

[11] Patent Number: 5,706,867

[45] Date of Patent: Jan. 13, 1998

[54] MAGNETIC WEAVING METHOD USING LATERAL AND LONGITUDINAL STRIPS

[76] Inventor: Yueh Chiao Liao, P.O. Box 63-99, Taichung, Taiwan

[21] Appl. No.: 717,464

[22] Filed: Sep. 20, 1996

[51] Int. Cl.[6] ..... D03D 13/00

[52] U.S. Cl. ..... 139/11; 139/134; 139/29

[58] Field of Search ..... 139/134, 11, 29, 139/425 R

[56] References Cited

U.S. PATENT DOCUMENTS 3,817,292 6/1974 Doehler et al. ..... 139/55
5,454,403 10/1995 Kerr et al. ..... 139/425 R
5,527,105 6/1996 Riach, Jr. ..... 312/406
5,578,359 11/1996 Forbes et al. ..... 428/131

*Primary Examiner*—Andy Falik

[57] ABSTRACT

A method for weaving a sheet member by using lateral and longitudinal strips. A portion of the longitudinal strips are disposed in an alternating way relative to the other longitudinal strips and are moved upwardly and downwardly alternatively for forming a gap and for engaging with a lateral strip. The longitudinal strips are moved upwardly and downwardly by magnet members. A number of further magnet members engage with and move the lateral strip to one end of the longitudinal strips so as to weave the sheet member which may be used as a table top or a seat surface.

1 Claim, 7 Drawing Sheets

MAGNETIC WEAVING METHOD USING LATERAL AND LONGITUDINAL STRIPS

BACKGROUND OF THE INVENTION

1. Field of the Invention

The present invention relates to a method, and more particularly to a method for weaving a metal sheet member of a table top or a chair surface.

2. Description of the Prior Art

Typical chair surfaces or table tops may include a number of longitudinal plastic strips and lateral plastic strips woven together manually so as to form a sheet member. The strips may not be woven together automatically.

The present invention has arisen to mitigate and/or obviate the afore-described disadvantages of the conventional sheet member weaving methods.

SUMMARY OF THE INVENTION

The primary objective of the present invention is to provide a method for weaving metal strips together so as to form a sheet member quickly.

In accordance with one aspect of the invention, there is provided a method for weaving a sheet member, the method comprises (a) preparing a plurality of lateral strips, (b) preparing a plurality of first longitudinal strips and a plurality of second longitudinal strips arranged in an alternating way, the first and the second longitudinal strips each including a first end portion and a second end portion, (c) pressing the first end portions of the first and the second longitudinal strips in place, (d) preparing a plurality of first magnet members for engaging with the second end portions of the first longitudinal strips, (e) preparing a plurality of second magnet members for engaging with the second end portions of the second longitudinal strips, (f) moving the first magnet members upwardly and downwardly for moving the second end portions of the first longitudinal strips upwardly and downwardly, (g) moving the second magnet members upwardly and downwardly for moving the second end portions of the second longitudinal strips upwardly and downwardly and for forming a gap between the second end portions of the first and the second longitudinal strips, (h) moving a first of the lateral strips into the gap for engaging the first lateral strip between the second end portions of the first and the second longitudinal strips, (i) preparing a plurality of third magnet members for engaging with the first lateral strip, and (j) moving the first lateral strip toward the first end portions of the first and the second longitudinal strips, and (k) repeating steps (f) to (j) for weaving the sheet member.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
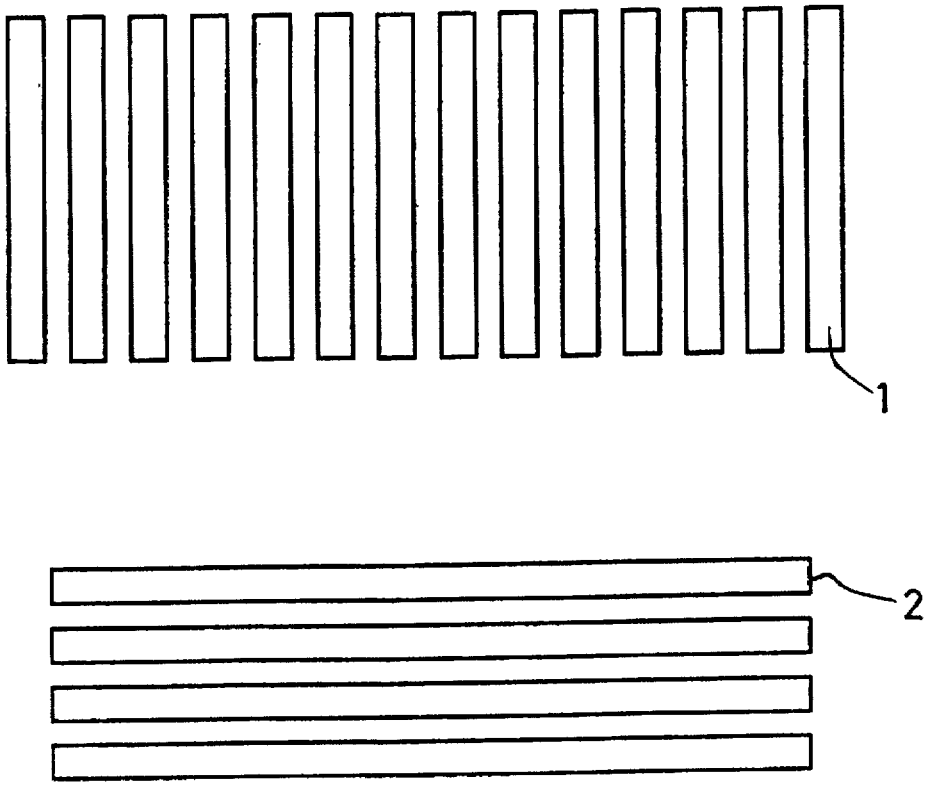
FIG. 1 is a top plane view illustrating the strips to be woven into the sheet member by a method in accordance with the present invention.
Figure 3:
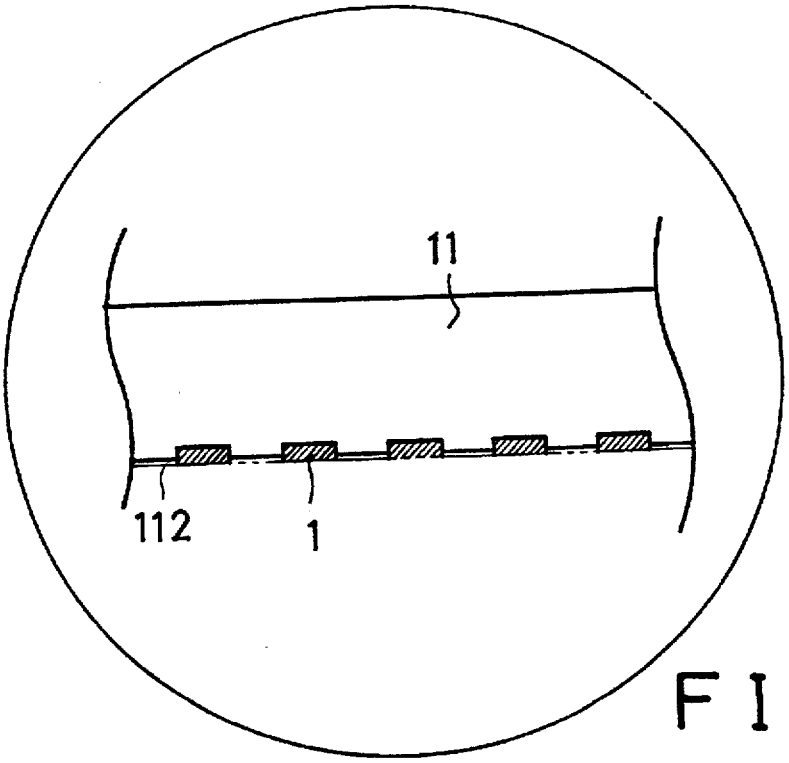
FIG. 3 is an enlarged partial plane view illustrating a presser.
Figure 2:
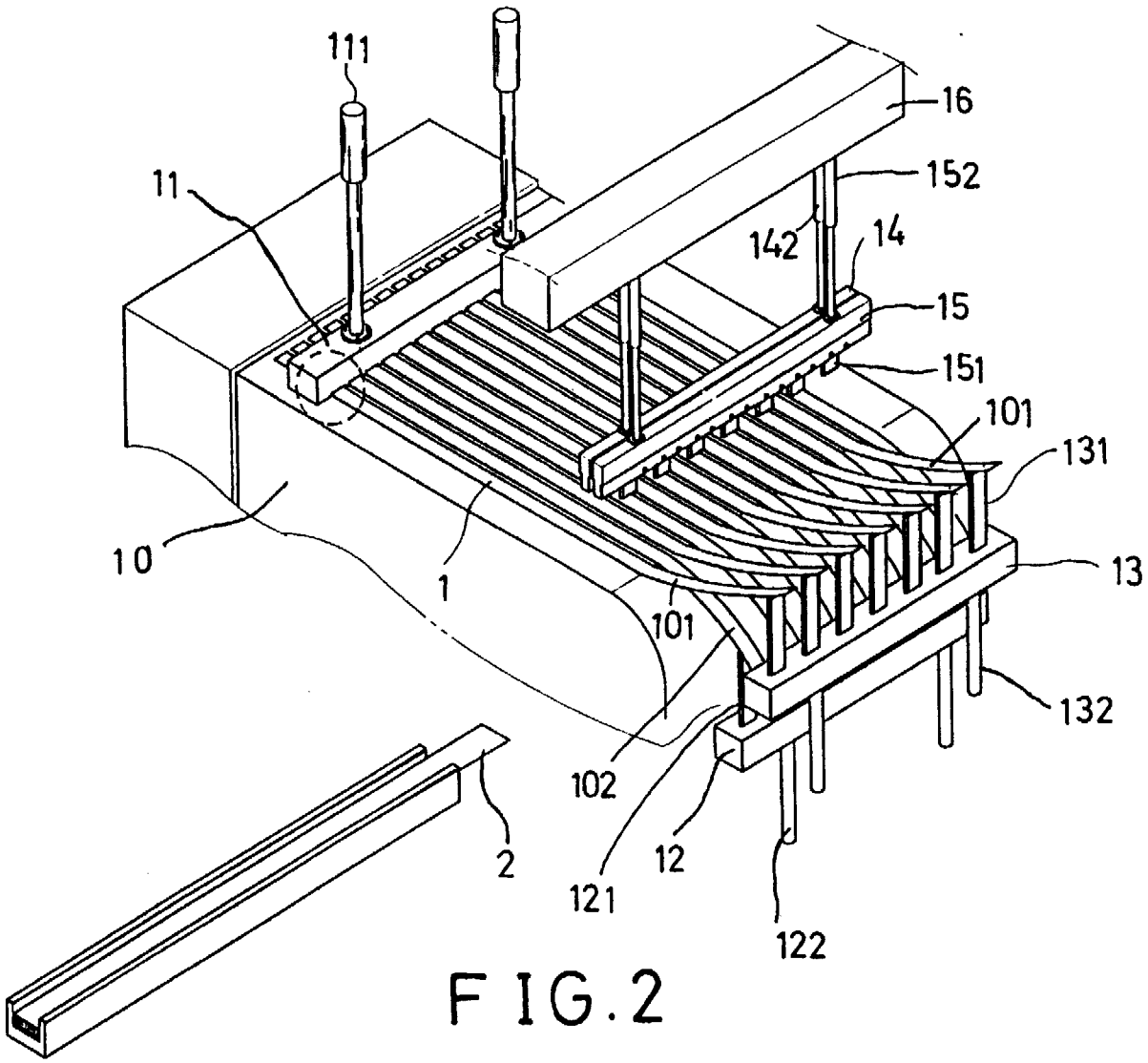
FIG. 2 is a perspective view illustrating a facility for conducting the method of the present invention.
Figure 8:
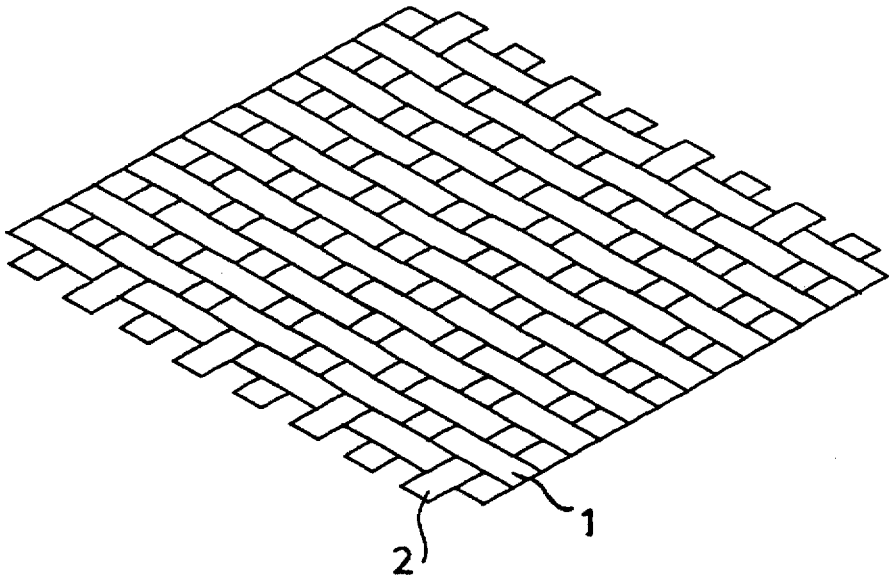
FIGS. 8 and 9 are perspective views illustrating the products made by the method in accordance with the present invention.
Figure 9:
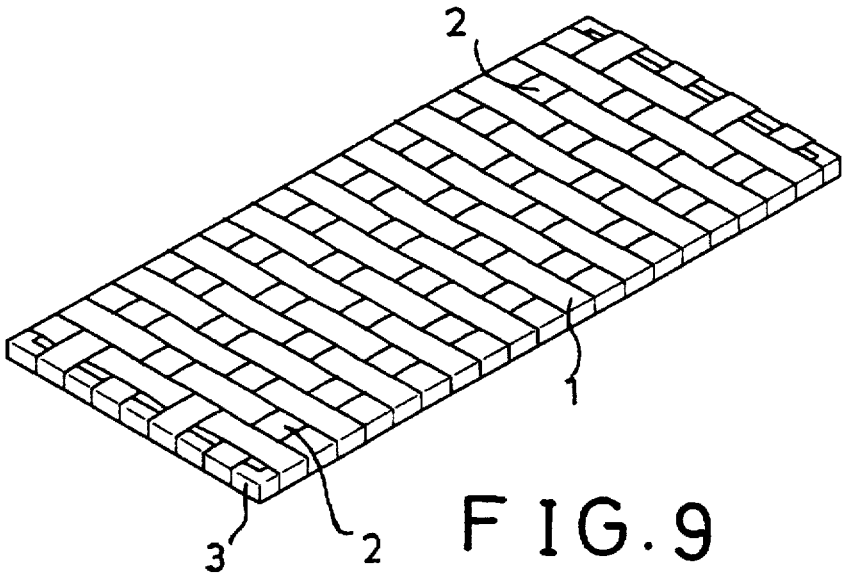

Referring to the drawings, and initially to FIGS. 1 to 3, a method in accordance with the present invention is provided for weaving a number of longitudinal strips 1 and a number of lateral strips 2 together so as to form a sheet member (FIG. 8) which may be used as a table top or a chair seat surface (FIG. 9). The longitudinal strips 1 and the lateral strips 2 are made of metal material that may be engaged with and attracted by magnet member. A facility for conducting the operating processes of the method comprises a table 10 for supporting the longitudinal strips 1 which are arranged parallel to each other. A presser 11 is secured to the bottom portion of one or more actuators 111 which may move the presser 11 downwardly to press the first end portions of the longitudinal strips 1 in place. It is preferable that the presser 11 includes a number of depressions 112 (FIG. 3) formed therein for engaging with the longitudinal strips 1 and for stably retaining the longitudinal strips 1 in place. The longitudinal strips 1 includes a number of first strips 101 and a number of second strips 102 arranged in an alternating way.

Figure 6:
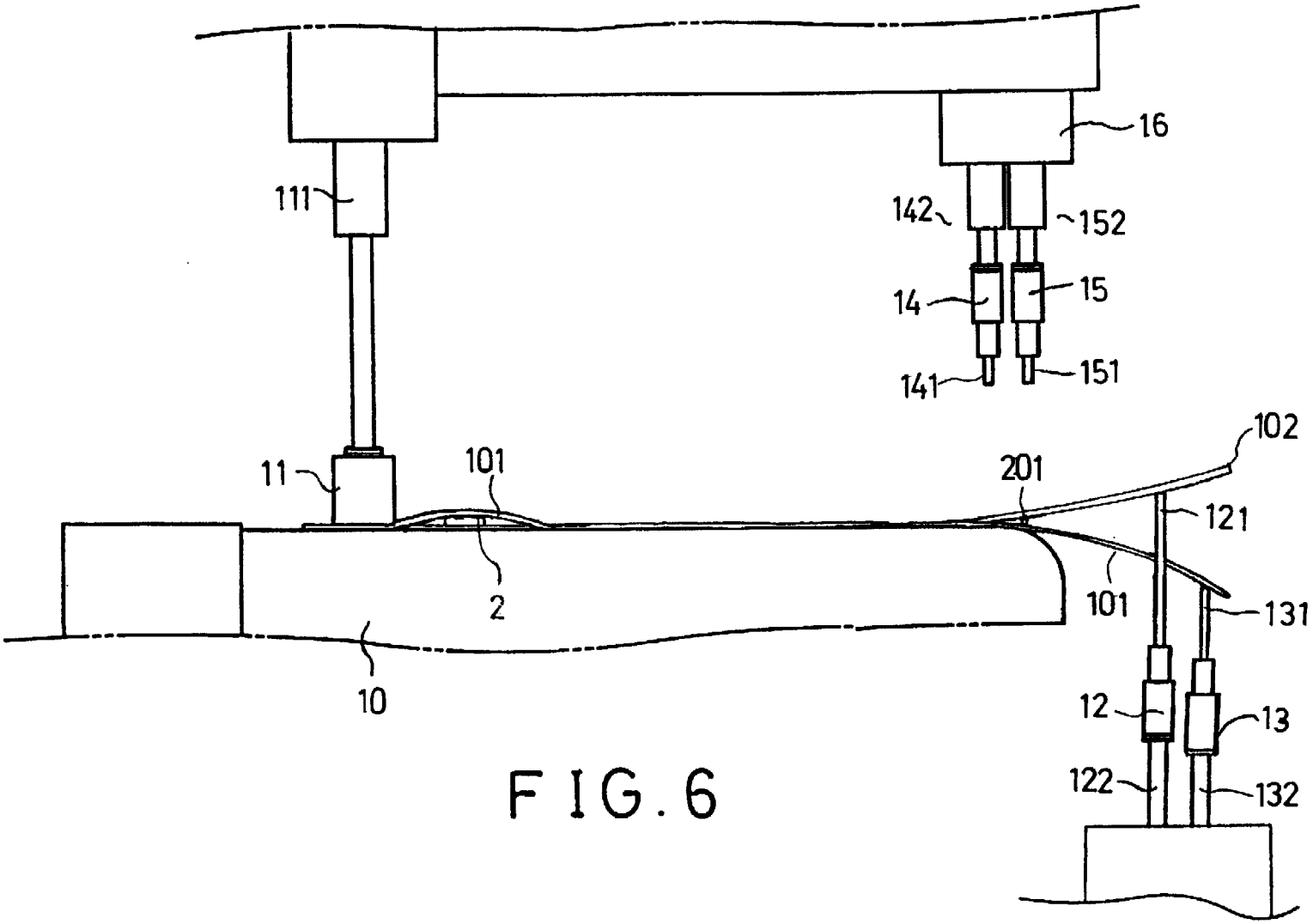
Figure 7:
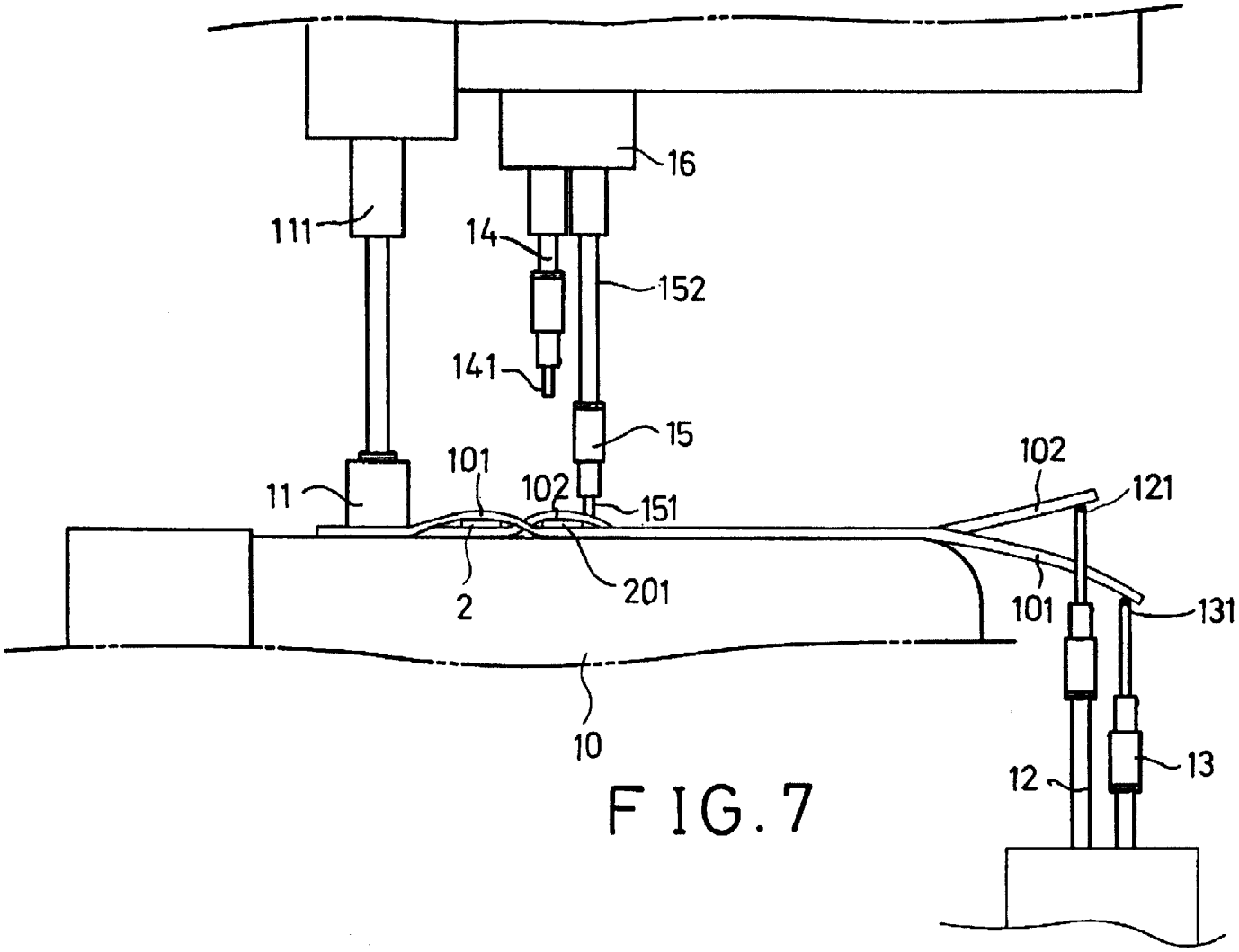

A pair of bars 12, 13 are disposed on the actuators 122, 132 respectively so as to be moved upwardly and downwardly by the actuators 122, 132. The bars 12, 13 each includes a number of magnet members 121, 131, or electromagnet members, arranged in an alternating way for engaging with the second end portions of the second strips 102 and the first strips 101 respectively and for moving the strips 102, 101 upwardly and downwardly. The magnet members 121, 131 may attract and may pull the second end portions of the strips 101, 102 downwardly. A lever 16 is movable in a longitudinal direction parallel to that of the strips 1 for allowing the lever 16 to move from the bars 12, 13 to the presser 11 and to move from the presser 11 to the bars 12, 13 and includes two pairs of actuators 142, 152 extended downwardly therefrom. A pair of beams 14, 15 are secured to the actuators 142, 152 so as to be moved upwardly and downwardly by the actuators 142, 152. The beams 14, 15 each includes a number of magnet members 141, 151 (FIGS. 4 to 7) arranged in an alternating way for engaging with the lateral strips 2 and for moving the lateral strips 2 along the longitudinal strips 1. The magnet members 141 may be engaged between the longitudinal strips 101 and may engage with the lateral strip 2 for moving the lateral strip 2 toward the presser 11 (FIG. 5). Additionally, the magnet members 151 may be engaged between the longitudinal strips 102 and may engage with the lateral strip 2 for moving the lateral strip 2 toward the presser 11 (FIG. 7).

Figure 4:
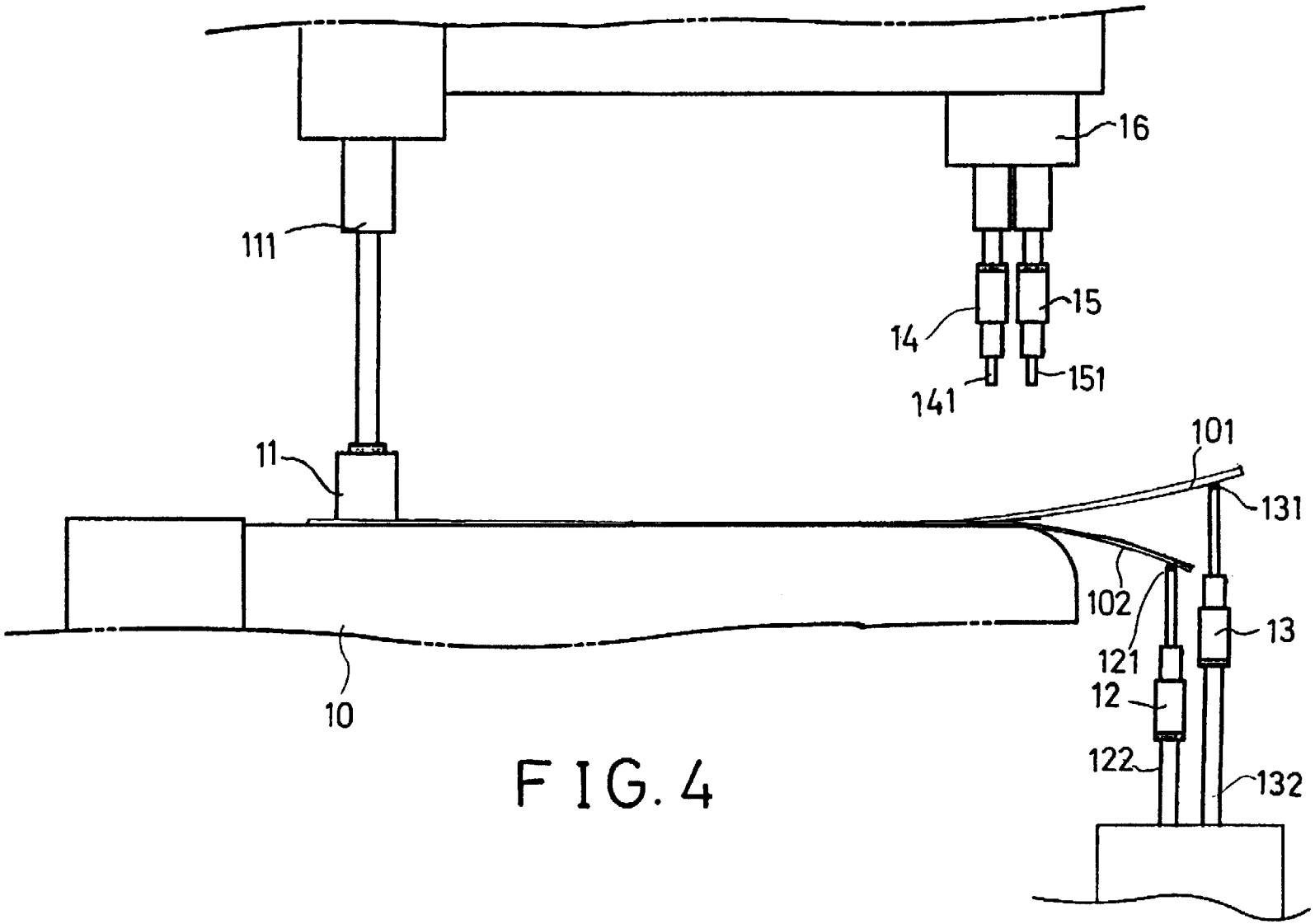
FIGS. 4, 5, 6, 7 are plane views of the facility, illustrating the operation of the method.
Figure 5:
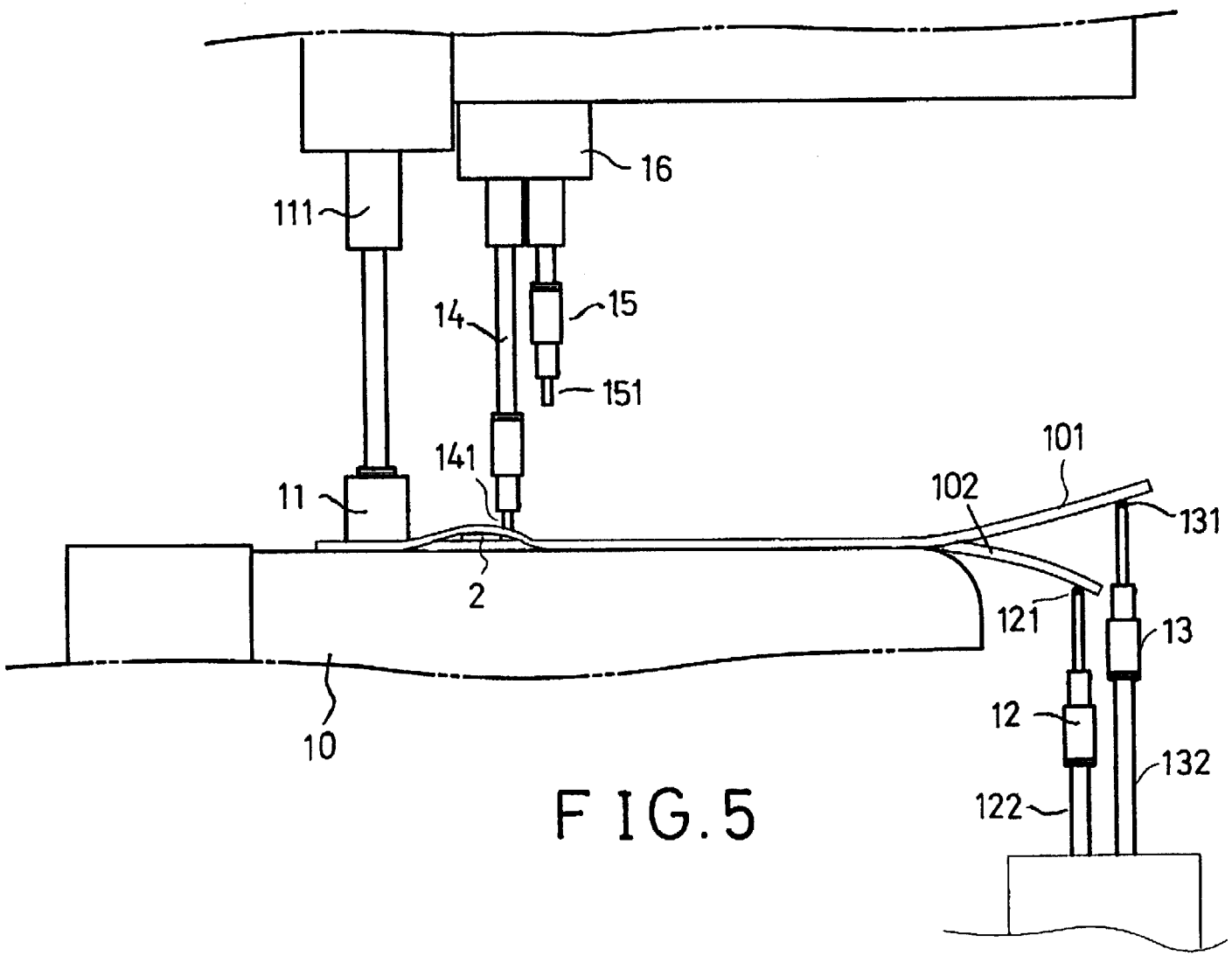

In operation, as shown in FIGS. 2 and 4, the second end portions of the first strips 101 are moved upwardly by the magnet members 131, and the second end portions of the second strips 102 are moved downwardly by the magnet members 121 so as to form a gap between the first and the second strips 101, 102 for inserting a lateral strip 2 into the gap formed between the first and the second strips 101, 102, by workers, for example. The lateral strips 2 may be engaged into the gap either manually or by a feeding machine. At this moment, the lever 16 is moved above the lateral strip 2. The beam 14 and the magnet members 141 are then moved downwardly to engage with the lateral strip 2 for moving the lateral strip 2 to the first end portions of the strips 1 (FIG. 5). As shown in FIG. 6, after the lateral strip 2 is moved to the predetermined position, the first strips 101 are moved downwardly by the magnet members 121 and the second strips 102 are moved upwardly by the magnet members 131 so as to form a gap between the second end portions of the first and the second strips 101, 102 and for inserting another lateral strip 201 into the gap manually, for example. As shown in FIG. 7, the magnet members 151 are then moved downwardly by the actuators 152 so as to engage with the lateral strip 201 and so as to move the lateral strip 201 toward the first end portions of the strips 1.

Referring next to FIG. 8, a sheet member may thus be formed and woven by the strips 1, 2 when the above described processes are operated for few operating cycles. The sheet member may then be secured on a frame 3 by such as welding process so as to form a seat cushion or a table top.

Accordingly, the method in accordance with the present invention may be used for weaving a sheet member automatically which may be used as table top or as a chair seat surface. The sheet members may be easily and quickly woven by the method.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A method for weaving a sheet member, said method comprising:

(a) preparing a plurality of lateral strips, (b) preparing a plurality of first longitudinal strips and a plurality of second longitudinal strips arranged in an alternating way, said first and said second longitudinal strips each including a first end portion and a second end portion, (c) pressing said first end portions of said first and said second longitudinal strips in place, (d) preparing a plurality of first magnet members for engaging with said second end portions of said first longitudinal strips, (e) preparing a plurality of second magnet members for engaging with said second end portions of said second longitudinal strips, (f) moving said first magnet members upwardly and downwardly for moving said second end portions of said first longitudinal strips upwardly and downwardly, (g) moving said second magnet members upwardly and downwardly for moving said second end portions of said second longitudinal strips upwardly and downwardly and for forming a gap between said second end portions of said first and said second longitudinal strips, (h) moving a first of said lateral strips into said gap for engaging said first lateral strip between said second end portions of said first and said second longitudinal strips, (i) preparing a plurality of third magnet members for engaging with said first lateral strip, and (j) moving said first lateral strip toward said first end portions of said first and said second longitudinal strips, and (k) repeating steps (f) to (j) for weaving the sheet member.

* * * * *